US006367952B1

(12) United States Patent
Gibboney, Jr.

(10) Patent No.: US 6,367,952 B1
(45) Date of Patent: Apr. 9, 2002

(54) PROGRAMMABLE STRING OF LIGHTS

(75) Inventor: James W Gibboney, Jr., Conyers, GA (US)

(73) Assignee: Ventur Research & Development INC, Suwanee, GA (US)

( * ) Notice: Subject to any disclaimer, the term of this patent is extended or adjusted under 35 U.S.C. 154(b) by 0 days.

(21) Appl. No.: 09/640,487

(22) Filed: Aug. 16, 2000

Related U.S. Application Data

(60) Provisional application No. 60/149,620, filed on Aug. 16, 1999, and provisional application No. 60/084,848, filed on May 8, 1998.

(51) Int. Cl.[7] ..... F21V 21/00

(52) U.S. Cl. ..... 362/249; 362/252; 362/253; 362/226; 439/414; 439/419

(58) Field of Search ..... 362/249, 226, 362/252, 253, 802, 807, 808; 439/414, 419; 315/18.5 R, 185 S, 193

(56) References Cited

U.S. PATENT DOCUMENTS

| | | | | |
|---|---|---|---|---|
| 3,927,315 A | * 12/1975 | Werry | ..... | 362/382 |
| 4,425,605 A | 1/1984 | Cheng | ..... | 362/227 |
| 4,675,575 A | 6/1987 | Smith et al. | ..... | 315/185 |
| 4,855,880 A | 8/1989 | Mancusi, Jr. | ..... | 362/123 |
| 4,870,547 A | 9/1989 | Crucefix | ..... | 362/123 |
| 5,777,868 A | 7/1998 | Gibboney, Jr. | ..... | 363/146 |
| 5,829,865 A | * 11/1998 | Ahroni | ..... | 362/226 |
| 5,967,644 A | 10/1999 | Pan | ..... | 362/249 |
| 5,994,845 A | 11/1999 | Gibboney, Jr. | ..... | 315/185 |
| 6,157,139 A | 12/2000 | Gibboney, Jr. | ..... | 315/185 |

* cited by examiner

*Primary Examiner*—Sandra O'Shea
*Assistant Examiner*—Bertrand Zeade
(74) *Attorney, Agent, or Firm*—Michael A Mann; Nexsen Pruet Jacobs & Pollard LLC

(57) ABSTRACT

A light for use in a string of lights has a lamp and a light socket that may include a parallel group device that may perform a variety of functions. One of those functions is to serve as a resistive element to regulate voltage and current to keep other lights in a group of lights arranged to be electrically in parallel lighted to the same intensity in the event one of the lights burns out or is removed. Another function of the parallel group device is to control the lamp in the socket so that it lights and goes out on command. The socket is designed to be closed against moisture and to be easily manufactured by hand or by machine. It includes piercing terminals that, when pressed into the electrical wires that run from light to light in the string, allow electrical connection with the lamp leads and the parallel group device leads.

21 Claims, 6 Drawing Sheets

PROGRAMMABLE STRING OF LIGHTS

PRIORITY CLAIM

The inventor claims the priority benefit US Provisional patent application Serial No. 60/149,620, filed Aug. 16, 1999, and US provisional patent application serial No. 60/084,848, filed May 8, 1998, subsequently regularized in Patent Cooperation Treaty application PCT/US99/09984, filed May 7, 1999.

FIELD OF THE INVENTION

The present invention relates generally to strings of lights such as those used for decorating Christmas trees.

BACKGROUND OF THE INVENTION

Strings of lights, that is, plural lights wired together to be powered from a plug inserted into a wall outlet, are used to decorate Christmas trees and homes. They are used for both interior decorating and exterior decorating.

For a 100-lamp light set, there are typically two types: two series circuits and three series circuits. The light sets both work the same, but the difference between the two is the brightness. One type is normal brightness and the other type is referred to as "super" bright. The difference in lamp brightness is attributable to the lamp voltage. The two series circuits have a lower lamp voltage per lamp (2.5V) i.e. 125/50. Each series circuit has 50 lamps.

The three circuit set has a higher per-lamp voltage of (3.5V) i.e. 125/35, for a much higher voltage and brighter lamp. Each circuit has 35 lamps in it. This means that a "super bright" 100-light set actually has 105 lamps in it.

Prior art light strings have the following parts: (1) an AC plug containing two 3 Amp fuses with 1 line side and 1 neutral side, (2) 6"–7" interconnecting wires (22AWG) between each socket in the series; (3) 1 AC receptacle at the end of the set; (4) 1 "return" or neutral line (22AWG) from the receptacle on the end of the set and then back to the last socket of each circuit in the set until it eventually terminates at the plug; (5) 1 "hot" line (22AWG) from the plug to the first socket in the first circuit in the set; (6) 1 "hot" line (22AWG) from the plug to the additional series circuits remaining in the set; (7) plastic light sockets for two wires; (8) plastic light sockets for three wires; (9) two brass electrical terminals per wire; (10) plastic lamp plugs to hold the lamps; and (11) miniature glass lamps.

Using the 'Super Bright' set as an example, the prior art light string has 104, 6" or 7" wires, depending on overall set length, each wire is cut, both ends of each striped back ¼", and bundled in groups of 104. The two, brass electrical terminals, are manually crimped onto each wire; one at each end, for a total of 208 terminals—and 208 hand operations. Some of these terminals will have two wires crimped into them to cascade a line, such as the "return" line or the "AC line", from one circuit to the next. The "return" line (as an example) is about 18 ft. in length and runs from the AC plug to the last socket of the first circuit, whereas the "AC line" runs from the AC plug (male) to the first socket in the first group. A second 18 ft. "return" wire is also crimped into the same terminal to pass the "return" to the last socket of the second circuit. Finally, a third, 18 ft. "return" line is crimped to the "return" line of the second set to pass the "return" line to the last socket in the third and final set. From that last socket another, shorter "return" line (6") is crimped into the last socket "return" line which terminates at the AC receptacle (female) at the end of the set.

Every lamp socket is connected in the series via a 6" line having a terminal crimped onto each end, with the last socket in each series circuit having two wires crimped in one of the terminals to cascade the line to the next series circuit. So the final tally on individual wires in a series light set is 109 wires; all with crimped on terminals at each end.

During assembly, each terminal and wire is inserted by hand through the bottom of the socket and then pulled down into a crevice (mounting) to hold the terminal firmly in place inside the socket. This insertion, mounting and pulling operation happens two times to each socket; once, for each terminal. When there are three or four wires, the operation takes considerably longer, as the double wire terminals do not easily fit or bend for mounting into the crevice. Even when a larger, special socket is used, the insertion of the second terminal is still very difficult, often causing wires to be cut or to be pulled out of a terminal and eventually causing a short circuit.

Furthermore, the bottoms of the sockets are open, so water from rain, snow or spills can enter the socket, and in colder regions where there is ice in winter, often salt-saturated water penetrates the sockets causing corrosion and arcing. The wires are crimped into brass terminals which during the assembly process are twisted and pulled, often loosening wires from the crimp and causing the crimp connection to loosen and the wires can pull out easily or worse, cause arcing inside the socket producing sparks—one of the primary causes of Christmas tree fires and light set failures.

Furthermore, the open bottom allows atmospheric conditions to accelerate contact breakdown due to acidic corrosion, Galvanic effects due to dissimilar metals, electrical current flow and the presence of salt-laden moisture. This greatly reduces the life and safety of the prior art light sets.

Finally, most of the miniature light set manufacturers today cannot pass the current UL588 test for 'Leakage current' due to the open bottom of the socket, consequently they have to put a tag on the light set that says "For indoor use only"; however, many people disregard this notice and use the light sets outside, a dangerous and hazardous situation.

Thus there is a need for a safer and easier to manufacture light set.

SUMMARY OF THE INVENTION

The present invention is a string of lights comprising plural groups of lights, each light in each group being electrically in parallel with each other light in the same group, each group of lights being electrically in series with each other group in the set and the string being terminated in a plug that rectifies incoming alternating current to direct current and limits current through the circuit. Importantly, in each group of lights, and also electrically in parallel with each other light in the group, is a device that controls the lights in that group. This device can control the group in several ways. In at least one way, it allows the current to flow across that group from the previous group to the next one without shorting the whole light string in the event that one or more of the lights in that group is removed or burns out. In another embodiment, it can turn out the lights in that group in a programmed sequence or on command.

The present invention is also a light socket for use in a string of lights that allows manufacture of the present string, or indeed, of any string of lights where the present socket is used, to be done much more easily. In fact, it allows the automation of the light string manufacturing process.

The light socket includes a sleeve, a base, and a pair of piercing terminals. There are three variations on the light socket depending on whether it is a "four wire" configuration, a "three wire" configuration or a "three wire" with a device. A "two-wire" configuration is also possible.

A feature of the present invention is that it operates at a lower electrical current than prior light strings. A lower current requirement in turn translates into a cooler light string and a safer light string.

Another feature of the present invention is that the use of device in each group of lights makes it easier to determine which bulb is missing or burned out because the remaining lights will continue to light.

Still another feature of the present invention is that because of its simple design, the present light string can be assembled much more quickly by hand and can be fabricated by machine.

Yet another feature of the present invention is the incorporation of a programmable device into each group or indeed in each socket. This feature enables control of the lights in ways previously unknown.

These and other features and their advantages will become apparent to those skilled in the art of the manufacturing and use of strings of lights from a careful reading of the Detailed Description of Preferred Embodiments, accompanied by the drawings.

DETAILED DESCRIPTION OF PREFERRED EMBODIMENTS

The present invention is a string of lights such as might be used to decorate a Christmas tree. In the preferred embodiments described below, the present invention will be illustrated as a Christmas tree light string using smaller, "mini" lights but it will be clear that larger or smaller lights can be used and that the present invention can be a light string used in other applications.

A "string of lights" means a plurality of lights all of which are in electrical connection with each other and a plug go that, when the plug is connected to a source of electricity, all of the lights light up.

Figure 1:
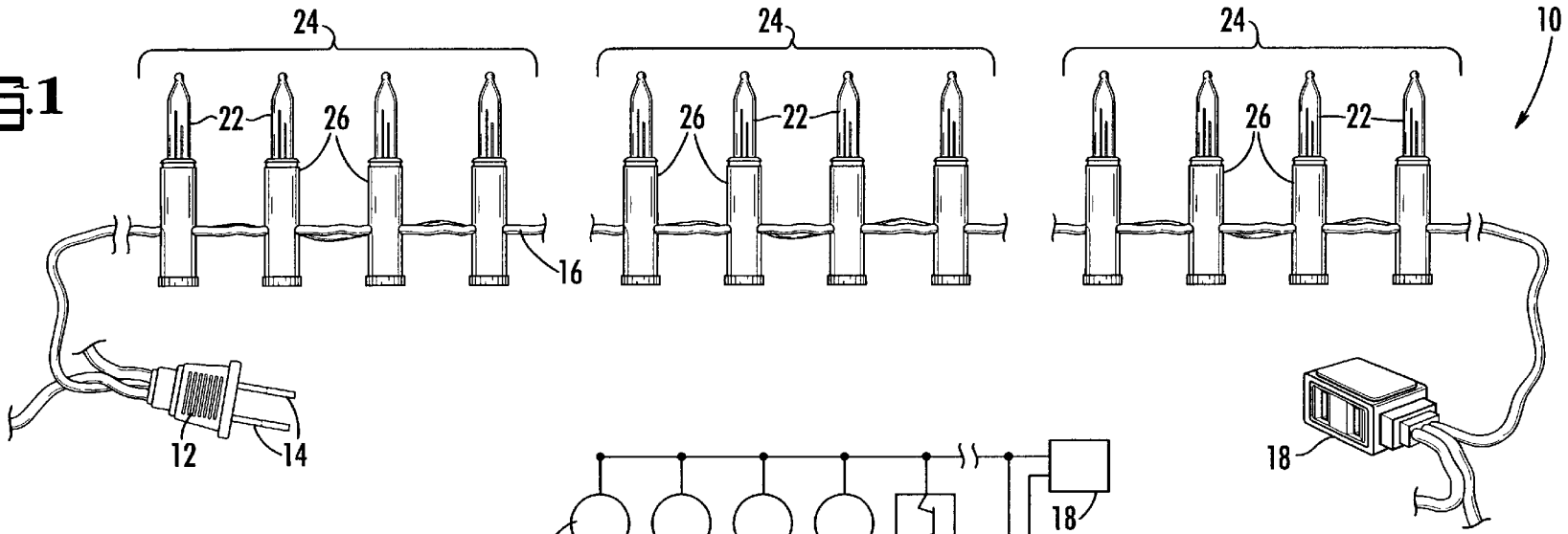
FIG. 1 is a perspective view of a section of a string of lights, according to a preferred embodiment of the present invention.
Figure 2:
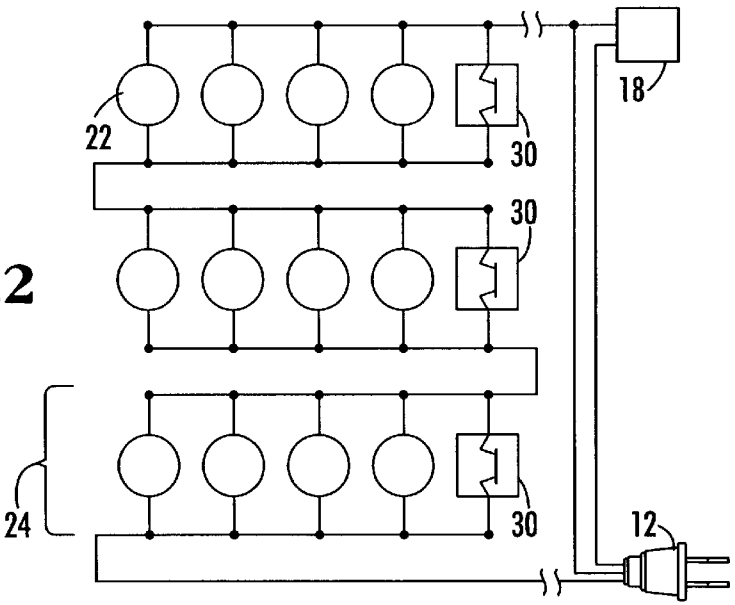
FIG. 2 is a schematic view of an electrical circuit for a string of lights, according to a preferred embodiment of the present invention.

Referring now to FIGS. 1 and 2, there is illustrated a preferred embodiment of the present invention in perspective and schematic form, respectively. A light string 10 includes a plug 12 having two terminals 14 that are insertable into a wall socket (not shown) or other source of electrical current and plural lights 16 that are physically and electrically connected by wires 18. String 10 terminates in a female plug 20 that can receive another plug 12 from another string of lights.

Plug 12 is preferably one that converts alternating current to direct current and limits current to protect string 10 from excessive current. A plug of this type is disclosed in U.S. Pat. No. 5,777,868, which is incorporated herein by reference.

Each light 16 includes a socket 26 and a lamp 22. Lights 16 are arranged in groups 24 and the groups connected together. As illustrated, there four lights 16 in a group 24.

Running between each light 16 in a group 24 are two wires 18; from lights 16 of one group 24 to lights 16 of another group 24 there is one wire 18. Note that there is a return wire 18 running from plug 12 to female plug 20. Except for the variation in the number of wires running from one light 16 to the next light 16, there is no difference between string 10 and the prior art light strings.

FIG. 2, in addition to showing the basic arrangement of lights 16, wires 18, groups 24 and plugs 12 and 20, also illustrates a parallel group device 30 connected electrically in parallel with each light 16 in a group 24. The arrangement of light string 10 into groups 24 and its function including that of parallel group device 30 is disclosed and described in PCT/US99/09984, which is incorporated herein in its entirety by reference.

In one embodiment, parallel group device 30 is composed of an integrated circuit comprised of multiple semiconductor junctions cascaded in a series fashion, or, alternatively, of a bipolar device; the number of semiconductor junctions is determined by the lamp voltage. If a lamp 22 bums out, its contacts degrade or it is removed from the group 24, the voltage drop across the remainder of the group 24 changes slightly because of the increased current flow across the remaining lamps and because of the voltage drop due to the resistance of the wire itself.

By using PN junction semiconductors or custom bipolar devices, which have voltage drops across them of a magnitude that depends on the design and material that the semiconductors are made of, a device 30 can be constructed that is pre-programmed to regulate the current flowing through, and the voltage drop across, group 24 so that it does not exceed a particular level and remains constant no matter what happens to an individual lamp 22.

For use with a DC electrical plug, as described in U.S. Pat. No. 5,777,868, this device 30 can comprise two silica diodes, each with a 1.1 volt forward voltage drop separated by a Zener diode with a 0.7 forward voltage drop for a 2.9 volt total, nearly matching the three volt drop across the lights. For a conventional AC electrical plug, six diodes, three in each direction, would be used. In another embodiment, a multi-junction, application-specific integrated circuit (ASIC) could be used that would functionally imitate the series of diodes. The integrated circuit could be a discrete component containing multiple PN junctions or a custom bipolar junction. It will be clear to those skilled in the art of integrated circuit fabrication that a multi-junction containing these specification could be made without undue experimentation.

The configuration of the parallel group device 30 assures that the voltage drop across the group 24 is always approximately three volts regardless of the number of bulbs missing, burned out, or whose contacts are degraded. If a lamp 22 is removed, for example, and the current riscs, the reverse bias of the Zener diode is overcome. When it breaks down, it begins to conduct, thus in effect replacing the missing bulb. Preferably, the Zener diode does not have a sharp threshold for breaking down and can be selected to somewhat gradually begin passing current. Likewise, a custom bipolar device could be fashioned to produce like results.

Figure 3B:
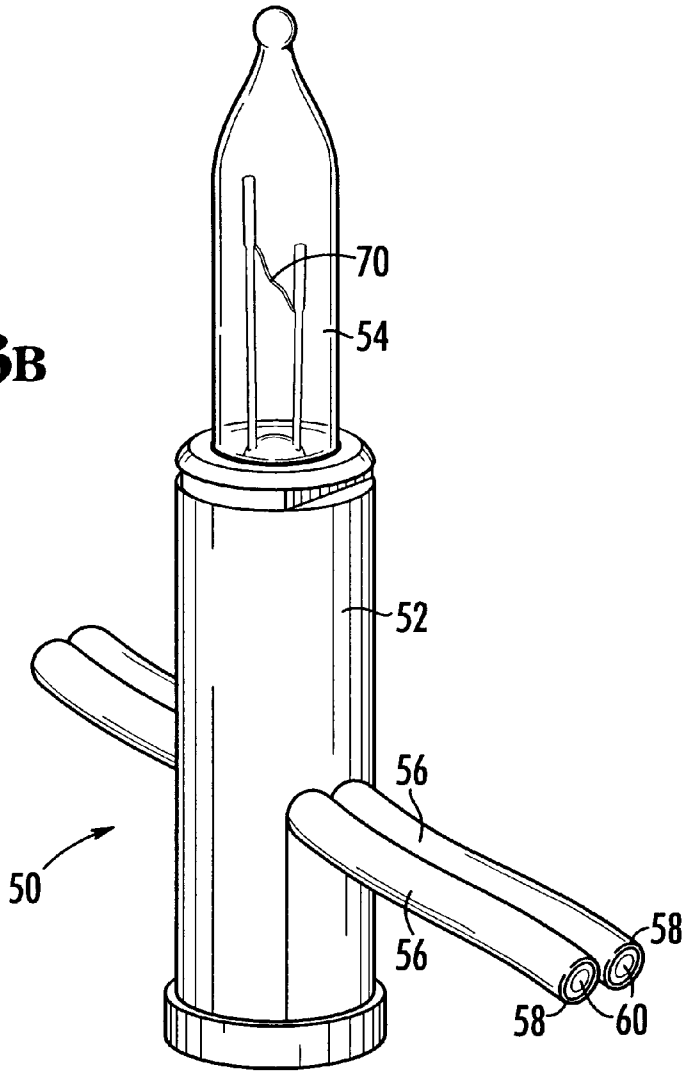
FIGS. 3A and 3B are perspective views of the exteriors of a four wire and a three wire embodiment of a socket, according to a preferred embodiment of the present invention
Figure 3A:
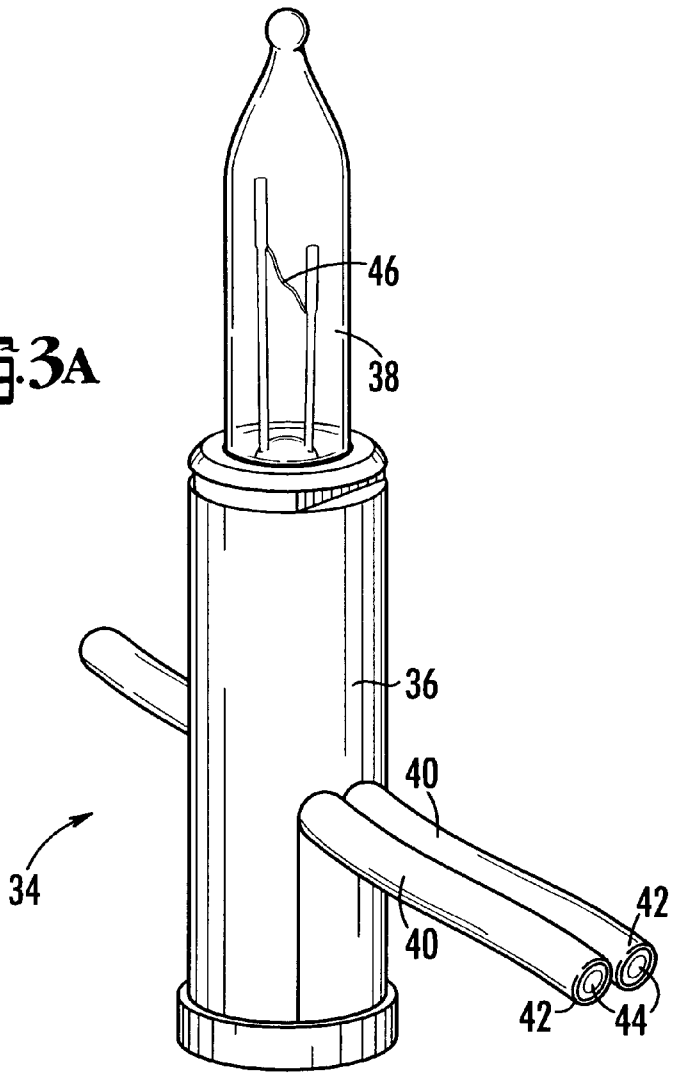

FIGS. 3A and 3B illustrate in perspective the two primary embodiments of lights 16 of the present invention. FIG. 3A shows a "three-wire" configuration for a light 34 and FIG. 3B illustrates a "four-wire" configuration for a light 50. Both light 34 and light 50 have sockets 36 and 52, respectively, and lamps 38 and 54 respectively. Both light 34 and light 50 have wires 40 and 56 that include insulation 42, 58, surrounding a core 44, 60.

Figure 4A:
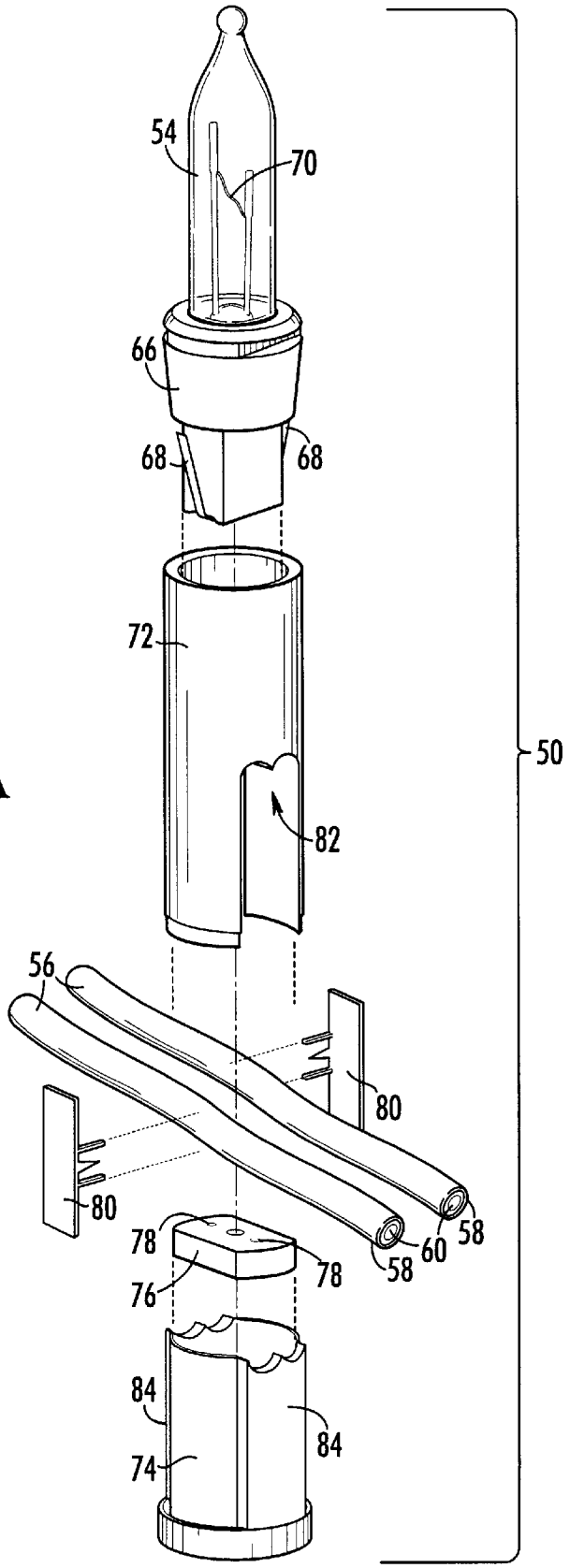
FIG. 4A is an exploded view of a four wire socket, according to a preferred embodiment of the present invention.
Figure 4B:
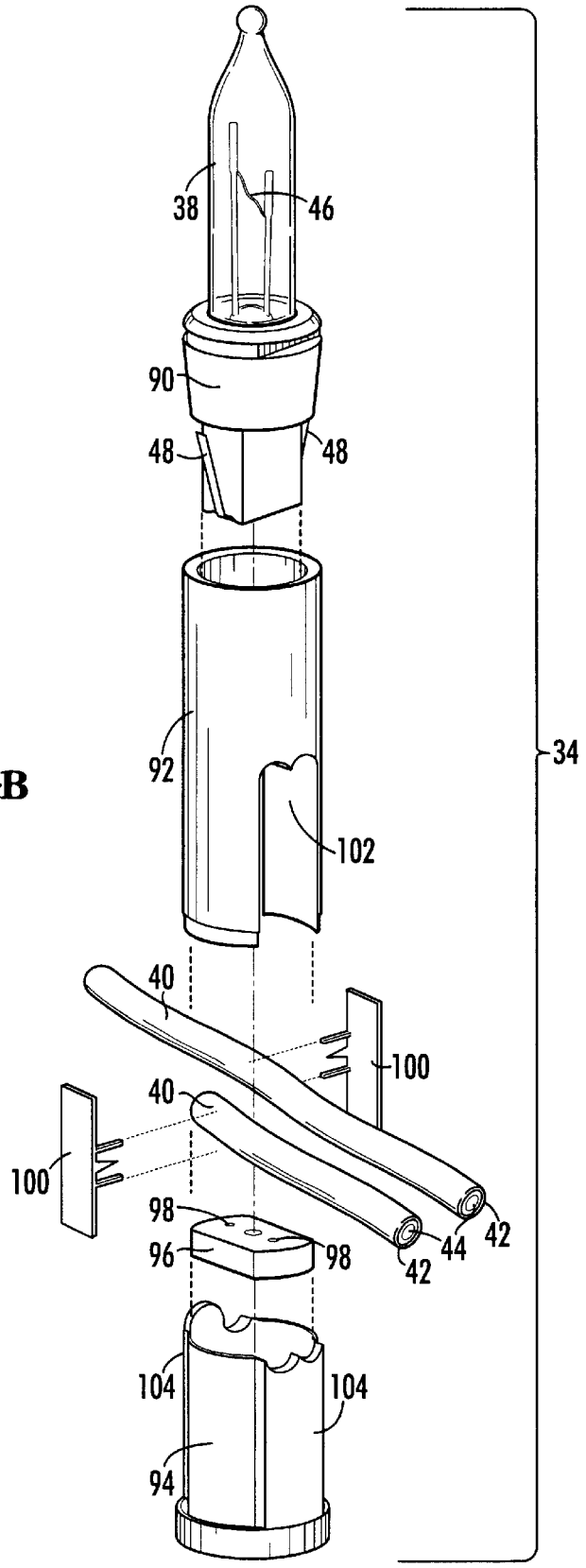
FIG. 4B is an exploded view of a three wire socket, according to a preferred embodiment of the present invention.
Figure 4C:
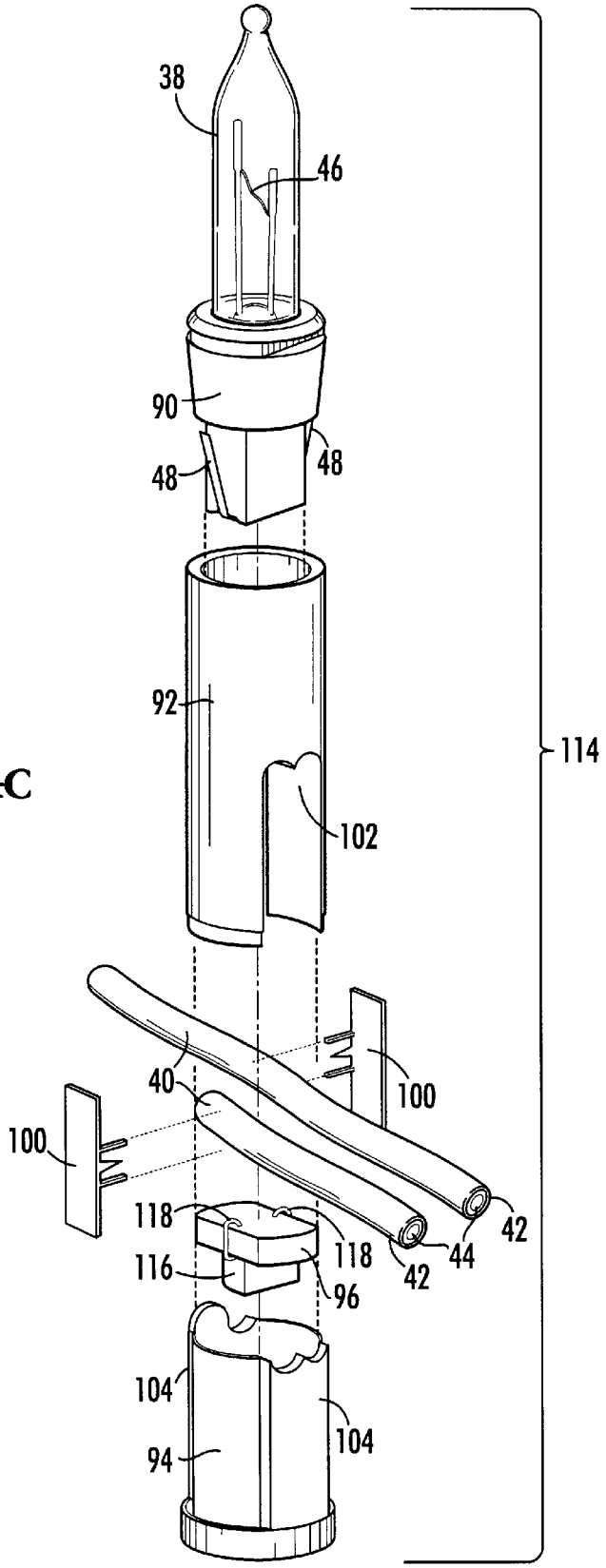
FIG. 4C is an exploded view of a three wire socket with a programmable device, according to a preferred embodiment of the present invention.

FIGS. 4A, 4B, and 4C illustrate exploded perspective views of light 50, and two embodiments of light 34. Referring first to FIG. 4A, which shows light 50 comprising lamp 54 in a lamp fitting 66 with two conducting electrical leads 68 that permit a voltage to be applied across a filament 70. Lamp fitting 66 is pressure fitted into a sleeve 72.

A light base 74 is dimensioned to receive a lead block 76 having two holes 78 formed therein. In this embodiment, holes 78 serve no purpose. However, in alternative embodiments, holes 78 may receive the leads from a device located in light base 74.

Two self-piercing, double ended, chamfered terminals 80 are pressed into one each of two wires 56 to make contact with cores 60 and are then inserted into light base 74 before sleeve 72 is lowered onto light base 74. Terminals 80 are made of a conducting metal and when seated in light base 74 will make electrical contact with electrical leads 68 and core 60, applying the voltage carried by wires 56 across filament 70.

Sleeve 72 has cutout portions 82 that receive wires 56 therein. Light base 74 has flanges 84 that have a corresponding, wire-receiving shape to fill the remaining parts of cutout portions 82 not occupied by wires 56. Note that to assemble light 50, terminals 80 need only be pressed into wires 56 far enough to pierce through insulation 58 to reach core 60, and then terminals 80 can be inserted into lamp base 74. Sleeve 72 is lowered into place and lamp 54 with lamp fitting 66 can be inserted into the top of sleeve 72.

FIG. 4B illustrates that "three-wire" light 34 has all of the components of a "four-wire" light 50 as shown in FIG. 4A. However, one component is shaped differently, as will be described. The remaining components: lamp 38 with a filament 46 and a pair of electrical leads 48, a lamp fitting 90, a sleeve 92, a light base 94, a lead block 96 with holes 98 in it, and two electrically-conducting, self-piercing, double ended, chamfered terminals 100 all of which are analogous to the same elements of the "four-wire" light 50 illustrated in FIG. 4A. Sleeve 92 also has cutout portions 102 just as sleeve 72 has cutout portions 82. However, because one of the wires 40 terminates at light 34, one of the two flanges 104 of light base 94 is longer, at 106, to fill the part of cutout portion 102 that wire 40 would otherwise extend through. Because of this extension, sleeve 92 completely seals lamp fitting 90 to light base 94.

FIG. 4C illustrates a "three-wire" light 114 with a parallel group device 116 installed in the light base 94. For simplicity all components of light 114 are identical to light 34 except for the presence of parallel group device 116 in light base 94. Parallel group device 116 has two leads 118 that extend through holes 98 and are then wrapped around lead block 96 so that, when terminals 100 penetrate wires 40 and are seated in light base 94, they make electrical contact with both leads 118 and core 44.

The foregoing three-wire light 34 and four-wire light 50 are used in the basic configuration for a 100-lamp set. In assembling a 100-lamp set based on 25 groups of four lamps in parallel, the following components are needed: (1) a plug containing a rectifying circuit to convert alternating current (AC) to direct current (DC) and to limit the current sourcing ability of the plug to the load; (2) 24 3.5 ft lengths of interconnecting wire (22AWG) between four sockets to form a parallel group; (3) one 7.5 foot "Positive" line (22AWG) from the plug to the first socket in the first parallel circuit in the set; (4) one 55.5 foot "return" line (the negative line) (22AWG) from the last socket of the last parallel group; (5) 100 special universal programmable, series or parallel, sockets for two wires, three wires or four wires depending on application; (6) one plastic lamp (female) plug; and (7) 100 miniature glass lamps. Each group can be composed of a different number of lamps in parallel, if desired; the number four has been chosen for convenience.

This set only has two crimped-on terminals used to interface to the rectifying, current limiting plug. Each of the 100 miniature lamps is mounted in either a three-wire light socket 34, a four-wire light socket 50 or a three-wire light socket 114 with a parallel group device 116.

The heart of the present light set is parallel group device 116 which regulates voltage and current flow in every parallel circuit group 24. Because of use of an electrical series of groups of lights in parallel, savings of over 90% power consumption compared to that of the prior art light sets is possible. The device 116 is a critical element in this function. The present lights 34, 50 and 114 have been designed to hold device 116 that limits current when a lamp burns out or is removed. However, other functions in addition to that are possible. For example, device 116 can electronically short across and/or proportionally control, the lamp in the socket, such as an ASIC, thus extinguishing and/or varying the intensity of the lamp. This circuit may include a memory element and controller to apply a received signal at programmed times and intervals. If a device 116 capable of shorting a lamp were put into every lamp, then the light set could have totally random patterns of individual blinking lights; something that cannot be done with current miniature light set technology. These ASIC's could be Pulse modulated, RF or any number of controlling methods to generate any pattern imaginable using the lights without the use of special SCR and TRIAC controllers, and the associated heat and individual, bulky, heavy, hard-wired circuits. The wiring of the presently described embodiment of a light set wiring would not change at all to perform any number of this type of "personality" functions. By "personality" functions, it is meant that a string of lights that might externally be identical to another string of lights could be programmed to operate in a much different way, making it at least different and potentially unique. The functions that cause individual lights to go out can be random, or a "light chase" sequence, or based, for example, on the color of the lamp or the tempo of music.

Each device can recognize a simple address transmitted down the power line; i.e. Group # and lamp #; ex. 12:3= group 12, lamp 3. This group addressing scheme makes the programmable devices very inexpensive.

This light set design, with the lamp installed, is submersible, so it can be used indoors or outdoors. It can be programmed to use only two wires for a series set (one in and one out); three wires for parallel to series and series to parallel configurations, i.e. one in and two out and two in and one out; and "four" wires (actually two wires passing straight through, i.e. two in one side and two out the other). Not only is the present light socket safer from accidental shock due to water conduction, but due to the nature of the plug, electrocution is highly unlikely. The present socket also saves time and eliminates hand operations for light set assembly. The present socket is designed for total automation, unlike the prior art light sets.

Figure 5B:
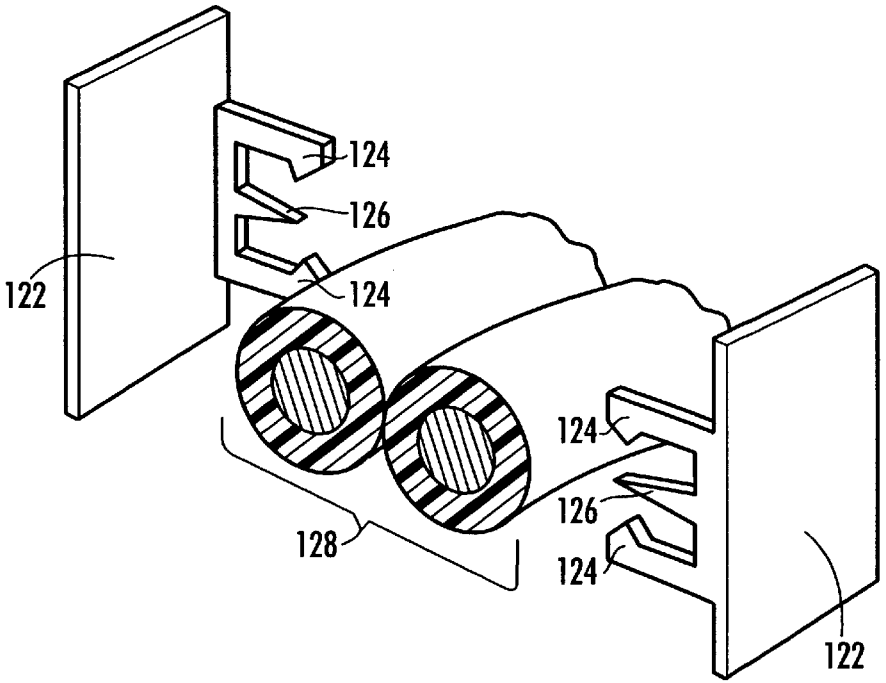
FIGS. 5A and 5B illustrate an alternative pair of piercing terminals, according to a preferred embodiment of the present invention.
Figure 5A:
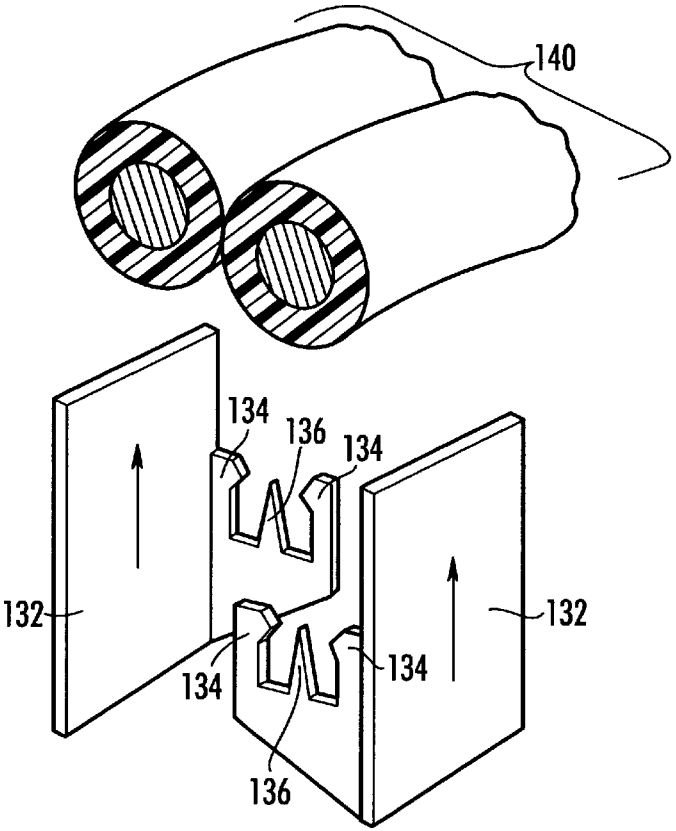
Figure 1:
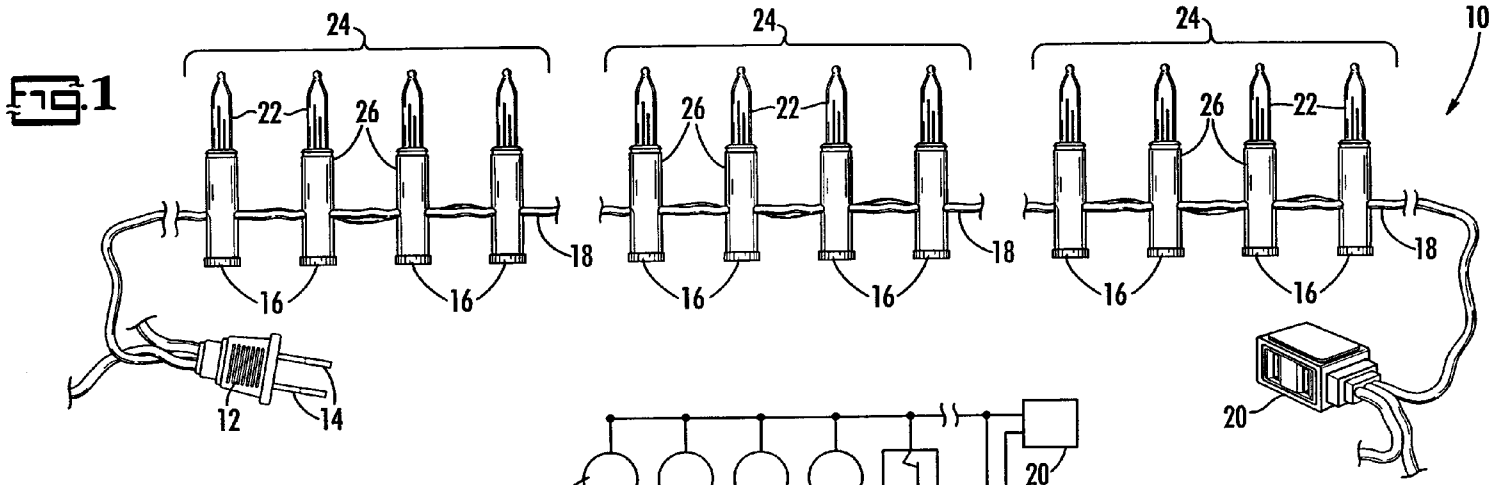
Figure 2:
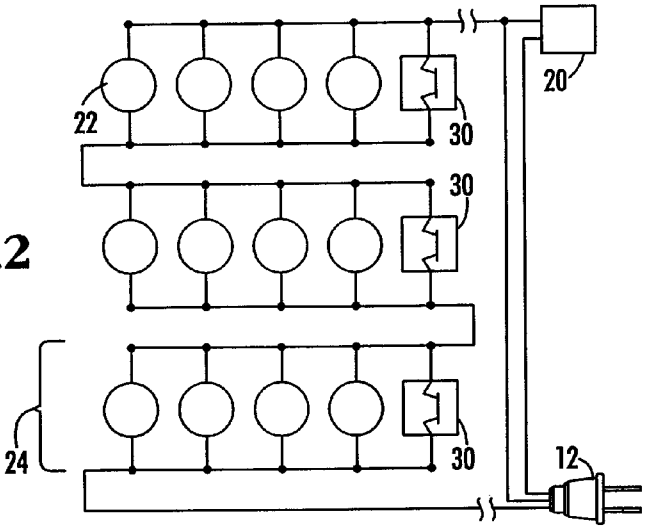
Figure 4B:
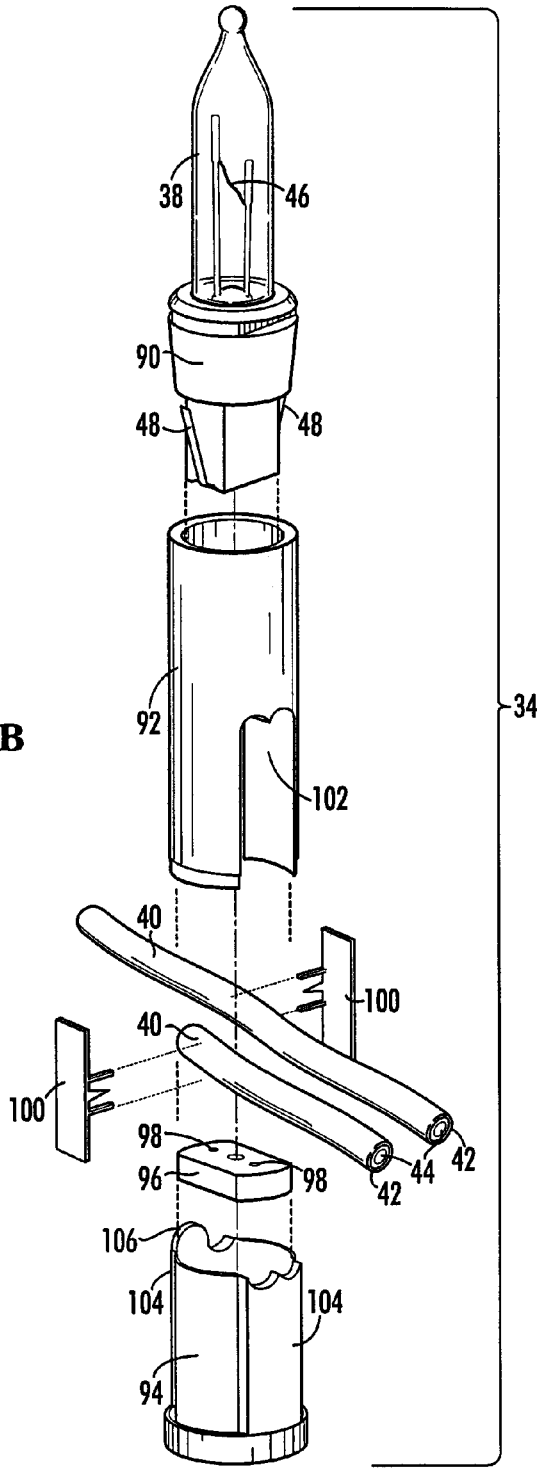
Figure 4C:
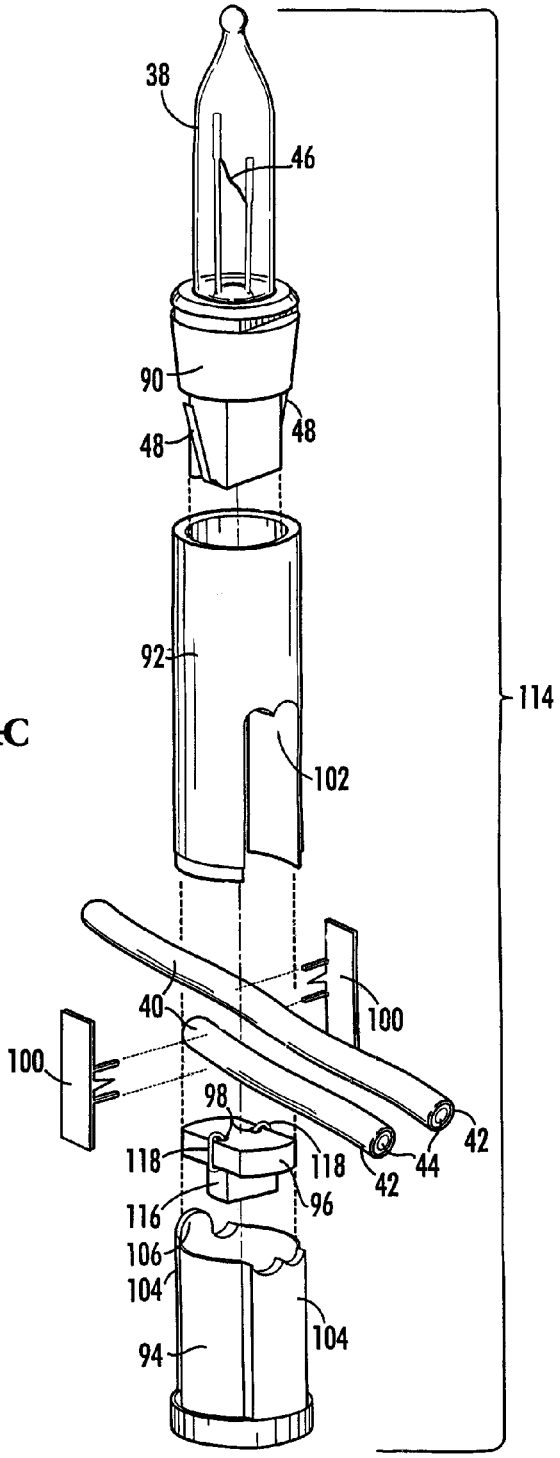

Automation is made possible via a slight modification of terminals 80, 100. In FIGS. 5A and 5B, alternative embodiments of terminals 80, 100, are shown as electrically-conducting, self-piercing, double ended, chamfered terminals 132, 122. With respect to FIG. 5A, the pair of terminals 132 accept wires 140 from the top, or parallel to each terminal's 132 face, so that the wires 140 can be inserted and loaded down onto the piercing elements 136 and between the grasping arms 134 of the terminals 132 from the top by machine. With respect to FIG. 5B, the pair of terminals 122 similarly have piercing elements 126 and grasping arms 124. In this embodiment, however, the terminals 132 are pressed into the wires 128 in a direction that is perpendicular to the terminals' 122 faces.

During manual assembly of the present light set, the worker would take the one 7.5 ft. wire (positive wire from plug 12) and would locate a point on the wire that is 6 ft. away from plug 12, pierce and lock a terminal 80 or 100 to the wire 18 (simple hand or tool operation). Next the worker would take a 42" wire 18 and attach another terminal 80 on its end. Then, taking a blank three wire light base 74, both terminals 80 or 100 are inserted into light base 74, then a sleeve 72 is placed over light base 74 and pushed on until it locks. Except for adding lamp 38 and lamp fitting 66, socket 36 is done. Next, the worker moves 6" down the pair of wires 18, places two terminals 100 at this 6" point, inserts terminals 100 into a four wire light base 94, places sleeve 92 over the top and locks it into place. This same four wire procedure is repeated for lamp three. Lamp four's socket will have a three-wire light 114 with a parallel group device 116, preferably an ASIC, mounted in it because this is the last socket in group 24. It will have one wire 18 exiting the group going to the next group 24 (see FIGS. 1 and 2) which means the other wire in this group terminates in this socket 36. The worker places a terminal 80 in the end of this short wire 18 and a terminal 80 directly across from it on the 'pass through' wire 18, then the worker inserts the terminals 80 into light base 94 with a device 116. Sleeve 92 is pushed down onto light base 94 and locked into place. This process is repeated until the set is completed. The wire coming from the last socket is the negative return line and is twisted back onto the set and terminated into plug 12.

In a manufacturing environment producing prior art sets, more than 25% of those sets do not work after the lamps are put into them. They go to great tables where hundreds of workers sit and start trouble shooting the sets trying to find the bad connection or bad lamp. This takes a lot of time for the manufacturer. Because of the design of the present light set, it should work practically every time and, furthermore, lamps not making good connection or are defective, can be easily seen when the set is tested and quality correction is handled quickly without a lot of time wasted. All of this adds up to a more reliable product designed to be easily manufactured by hand or machine. Fewer components means fewer hand operations and fewer defects and greater productivity: more product to ship in less time and a SPQL (Shipped Product Quality Level) approaching 100%. Current SPQL of prior art light sets is about 97%. That means for every 5 million sets exported, 150,000 don't work when they are opened. The bulk of the cost of the failed sets falls on the distributors and retailers because of logistical difficulties with returns to off shore manufacturers.

Because the assembly of the present light strings is so greatly simplified, it becomes a simple matter to add lights to a string. Lights can be placed closer together; if desired, they can be placed side by side. The closer the lights are spaced, the stiffer and more rigid. In the parallel wire configuration we can create shapes such as stars, Santas, reindeer, snowmen, circles, squares, triangles, etc., that will remain in the shape they were formed to due to the way the wires are held into position in the sockets.

It will be apparent to those skilled in the art of electrical light strings that many substitutions and modifications can be made to the preferred embodiments described above without departing from the spirit and scope of the present invention. For example, the parallel group device will work when used in a series light set, without parallel groups, provided that each socket has a device. The invention, therefore, is defined by the appended claims.

What is claimed is:

1. A light for use with a string of lights, said lights of said string being in electrical connection with each other by a pair of wires, said light comprising:

a lamp having a filament and a pair of leads in electrical connection to said filament;

a lamp fitting dimensioned to receive said lamp and said pair of leads;

a lamp base;

a sleeve carried by said lamp base and dimensioned to receive said lamp fitting, said sleeve formed to receive a pair of wires;

terminals carried within said lamp base and extending from said lamp base to said leads of said lamp, said terminals having means formed thereon for piercing said pair of wires when said pair of wires are received by said sleeve so that an electrical current carried by said wires can be applied to said filament of said lamp; and means carried by said lamp base for passing electrical current through said light when said lamp presents an open circuit to said terminals.

2. The light as recited in claim 1, wherein said terminals are formed to have double projections to grip said pair of wires once said wires are pierced.

3. The light as recited in claim 1, wherein said terminals further comprise two terminals, each terminal piercing one wire of said pair of wires.

4. The light as recited in claim 1, further comprising means carried by said lamp base for controlling electrical current flow through said leads from said pair of wires.

5. The light as recited in claim 1, wherein said sleeve is formed to allow one wire of said pair of wires to exit said sleeve.

6. The light as recited in claim 1, wherein said means for piercing pierces said pair of wires when said terminals are moved toward each other.

7. The light as recited in claim 1, wherein said means for piercing pierces said pair of wires when said pair of wires are passed between said terminals.

8. A light for use with a string of lights, said lights of said string of lights being in electrical connection with each other by a pair of wires, said light comprising:

a lamp having a filament and a pair of leads in electrical connection to said filament;

a lamp fitting dimensioned to receive said lamp and said pair of leads;

a lamp base;

a sleeve carried by said lamp base and dimensioned to receive said lamp fitting;

terminals carried within said lamp base and extending from said lamp base to said pair of leads of said lamp, said terminals being in electrical connection with said pair of wires when said pair of wires are received by said light; and electronic means in electrical connection with said terminals for passing electrical current through said light when said lamp presents an open circuit to said terminals.

9. The light as recited in claim 8, wherein said electronic passing means further comprises:

a lead block having a pair of holes; and an integrated circuit having a pair of leads, each lead of said pair of leads of said integrated circuit extending through a hole of said pair of holes.

10. The light as recited in claim 8, wherein said electronic passing means is located within said lamp base.

11. The light as recited in claim 8, wherein said passing means is located with said lamp base.

12. The light as recited in claim 8, wherein said electronic passing means further comprises means for controlling said light.

13. The light as recited in claim 12, wherein said controlling means is responsive to a signal so that the energization of said lamp is controlled in response to said signal.

14. The light as recited in claim 13, wherein said controlling means includes circuit means for storing and applying said signal.

15. The light as recited in claim 10, wherein said electronic passing means further comprises an integrated circuit electrically connected across said terminals and in parallel electrical connection with said lamp filament when said lamp filament is electrically connected to said terminals.

16. The light as recited in claim 10, wherein said electronic passing means further comprises a diode circuit electrically connected across said terminals and in parallel with said lamp filament when said lamp filament is electrically connected to said terminals, said diode circuit being forward biased when said string of lights is energized and having a forward voltage drop that will allow said diode circuit to conduct in the forward biased region of its voltage-current characteristic curve when said lamp presents an open circuit to said terminals.

17. The light as recited in claim 16, wherein said diode circuit is further comprised of a plurality of diodes electrically connected in series, each of said plurality of diodes being forward biased when said string of lights is energized, and said plurality of diodes being selected so that a total forward voltage drop across said plurality of diodes is of a magnitude that will cause said plurality of diodes to conduct in the forward biased region of their voltage-current characteristic curves when said lamp presents an open circuit to said terminals.

18. The light as recited in claim 17, wherein said diode circuit is further comprised of at least one Zener diode connected electrically in series with said plurality of diodes, said Zener diode being oriented so that it is reverse biased when said string of lights is energized, said Zener diode having a Zener breakdown voltage drop, and said diode circuit having a total voltage drop comprised of said Zener breakdown voltage drop and each forward voltage drop across each of said plurality of diodes, and said total voltage drop being of a magnitude that will cause said Zener diode to conduct in the Zener breakdown region of its voltage-current characteristic curve and said series connected diodes to conduct in the forward biased region of their voltage-current characteristic curves when said lamp presents an open circuit to said terminals.

19. The light as recited in claim 16, wherein said diode circuit is further comprised of a first plurality of diodes that are electrically connected in series and have their PN junctions similarly oriented, said first plurality of diodes are electrically connected in parallel with a second plurality of diodes that are electrically connected in series and have their PN junctions similarly oriented, said second plurality of diodes' PN junctions being oppositely electrically oriented in relation to the electrical orientation of the PN junctions of said first plurality of diodes, said first plurality of diodes being forward biased during a half of an AC cycle from an AC power source and said second plurality of diodes being forward biased during a opposite half of said AC cycle from said AC power source, said AC power source is used to supply power to said string of lights, and said first plurality of diodes are selected so that the total forward voltage drop across said first plurality of diodes is of a magnitude that will cause the first plurality of diodes to conduct in the forward biased region of their voltage-current characteristic curves when they are forward biased and said lamp presents an open circuit to said terminals, and said second plurality of diodes being selected so that the total forward voltage drop across said second plurality of diodes is of a magnitude that will cause the second plurality of diodes to conduct in the forward biased region of their voltage-current characteristic curves when they are forward biased and when said lamp presents an open circuit to said terminals.

20. A new light for use in a string of lights, said string of lights powered by an AC power source, said lights of said string of lights being in electrical connection with each other and transmitting AC power to each other by a pair of wires, said light comprising:

a lamp having a filament and a pair of leads in electrical connection to said filament;

a lamp fitting dimensioned to receive said lamp and said pair of leads;

a lamp base dimensioned to receive said lamp fitting and said pair of wires;

terminals carried within said lamp base and extending from said lamp base to said pair of leads of said lamp, said terminals being in electrical connection with said pair of wires when said pair of wires are received within said lamp base;

means in electrical connection with said terminals for providing rectified DC to said lamp; and means in electrical connection with said terminals for passing electrical current through said light when said lamp presents an open circuit to said terminals.

21. A group of lights for use in a string of lights, each light of said group of lights being in a parallel electrical connection with each other light of said group of lights, said group of lights comprising:

at least two lights having lamps; and means electrically connected in parallel with said group of lights for passing electrical current through said group of lights to compensate for the change in current caused by any of said lamps presenting an open circuit to said terminals.

* * * * *

UNITED STATES PATENT AND TRADEMARK OFFICE

CERTIFICATE OF CORRECTION

PATENT NO. : 6,367,952 B1
DATED : April 9, 2002
INVENTOR(S) : James W. Gibboney, Jr.

It is certified that error appears in the above-identified patent and that said Letters Patent is hereby corrected as shown below:

Title page,
Title page should be deleted to be replaced with the attached title page.

Drawings,
Drawing sheets, consisting of Figs. 1, 2, 4B and 4C, should be deleted to be replaced with the drawing sheets, consisting of Figs. 1, 2, 4B and 4C, as shown on the attached pages.

Column 3,
Line 65, should read -- are in electrical connection with each other and a plug so --

Column 4,
Line 37, should read -- determined by the lamp voltage. If a lamp 22 burns out, its --

Column 5,
Line 3, should read -- removed, for example, and the current rises, the reverse bias --

Signed and Sealed this

Twelfth Day of November, 2002

*Attest:*

*Attesting Officer*

JAMES E. ROGAN
*Director of the United States Patent and Trademark Office*

(12) United States Patent
Gibboney, Jr.

(10) Patent No.: US 6,367,952 B1
(45) Date of Patent: Apr. 9, 2002

(54) PROGRAMMABLE STRING OF LIGHTS

(75) Inventor: James W Gibboney, Jr., Conyers, GA (US)

(73) Assignee: Ventur Research & Development INC, Suwanee, GA (US)

( * ) Notice: Subject to any disclaimer, the term of this patent is extended or adjusted under 35 U.S.C. 154(b) by 0 days.

(21) Appl. No.: 09/640,487

(22) Filed: Aug. 16, 2000

Related U.S. Application Data

(60) Provisional application No. 60/149,620, filed on Aug. 16, 1999, and provisional application No. 60/084,848, filed on May 8, 1998.

(51) Int. Cl.[7] ..... F21V 21/00

(52) U.S. Cl. ..... 362/249; 362/252; 362/253; 362/226; 439/414; 439/419

(58) Field of Search ..... 362/249, 226, 362/252, 253, 802, 807, 808; 439/414, 419; 315/18.5 R, 185 S, 193

(56) References Cited

U.S. PATENT DOCUMENTS

| | | | | |
|---|---|---|---|---|
| 3,927,315 A | * | 12/1975 | Werry | 362/382 |
| 4,425,605 A | | 1/1984 | Cheng | 362/227 |
| 4,675,575 A | | 6/1987 | Smith et al. | 315/185 |
| 4,855,880 A | | 8/1989 | Mancusi, Jr. | 362/123 |
| 4,870,547 A | | 9/1989 | Crucefix | 362/123 |
| 5,777,868 A | | 7/1998 | Gibboney, Jr. | 363/146 |
| 5,829,865 A | * | 11/1998 | Ahroni | 362/226 |
| 5,967,644 A | | 10/1999 | Pan | 362/249 |
| 5,994,845 A | | 11/1999 | Gibboney, Jr. | 315/185 |
| 6,157,139 A | | 12/2000 | Gibboney, Jr. | 315/185 |

* cited by examiner

*Primary Examiner*—Sandra O'Shea
*Assistant Examiner*—Bertrand Zeade
(74) *Attorney, Agent, or Firm*—Michael A Mann; Nexsen Pruet Jacobs & Pollard LLC

(57) ABSTRACT

A light for use in a string of lights has a lamp and a light socket that may include a parallel group device that may perform a variety of functions. One of those functions is to serve as a resistive element to regulate voltage and current to keep other lights in a group of lights arranged to be electrically in parallel lighted to the same intensity in the event one of the lights burns out or is removed. Another function of the parallel group device is to control the lamp in the socket so that it lights and goes out on command. The socket is designed to be closed against moisture and to be easily manufactured by hand or by machine. It includes piercing terminals that. when pressed into the electrical wires that run from light to light in the string, allow electrical connection with the lamp leads and the parallel group device leads.

21 Claims, 6 Drawing Sheets

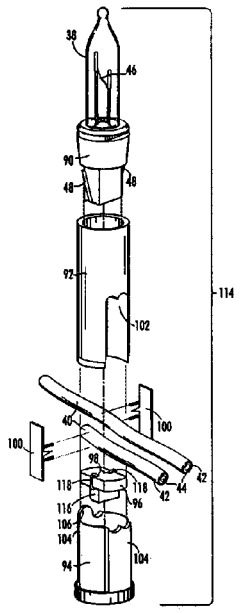

US006367952C1

(12) EX PARTE REEXAMINATION CERTIFICATE (5678th)

United States Patent

Gibboney, Jr.

(10) Number: US 6,367,952 C1

(45) Certificate Issued: Feb. 20, 2007

(54) PROGRAMMABLE STRING OF LIGHTS

(75) Inventor: James W. Gibboney, Jr., 3910 Dial Mill Rd., Conyers, GA (US) 33024

(73) Assignee: James W. Gibboney, Jr., Conyers, GA (US)

Reexamination Request:
No. 90/006,550, Feb. 19, 2003

Reexamination Certificate for:

| | |
|---|---|
| Patent No.: | **6,367,952** |
| Issued: | **Apr. 9, 2002** |
| Appl. No.: | **09/640,487** |
| Filed: | **Aug. 16, 2000** |

Certificate of Correction issued Nov. 12, 2002.

Related U.S. Application Data

(60) Provisional application No. 60/149,620, filed on Aug. 16, 1999, and provisional application No. 60/084,848, filed on May 8, 1998.

(51) Int. Cl.
*F21V 21/00* (2006.01)

(52) U.S. Cl. ..... 362/249; 362/252; 362/253; 362/652; 439/414; 439/419

(58) Field of Classification Search ..... 362/249, 362/252, 253, 642, 646, 652, 653, 654, 802, 362/807, 808; 315/185 R, 185 S, 193; 439/414, 439/419, 619, 699.2
See application file for complete search history.

(56) References Cited

U.S. PATENT DOCUMENTS

| | | | | | |
|---|---|---|---|---|---|
| 2,072,337 | A | * | 3/1937 | Kamm | 315/122 |
| 2,984,813 | A | * | 5/1961 | Bossi | 439/600 |
| 3,781,841 | A | * | 12/1973 | Hughes, Jr. | 340/642 |
| 4,223,248 | A | * | 9/1980 | Tong | 315/185 S |
| 4,298,923 | A | * | 11/1981 | Lin | 362/249 |
| 4,450,382 | A | * | 5/1984 | Sawka et al. | 315/82 |
| 4,727,449 | A | * | 2/1988 | Fleck | 361/54 |
| 5,495,147 | A | * | 2/1996 | Lanzisera | 315/185 S |
| 6,084,357 | A | | 7/2000 | Janning | |
| 2002/0101118 | A1 | | 8/2002 | Janning | |

* cited by examiner

*Primary Examiner*—Alan Cariaso

(57) ABSTRACT

A light for use in a string of lights has a lamp and a light socket that may include a parallel group device that may perform a variety of functions. One of those functions is to serve as a resistive element to regulate voltage and current to keep other lights in a group of lights arranged to be electrically in parallel lighted to the same intensity in the event one of the lights burns out or is removed. Another function of the parallel group device is to control the lamp in the socket so that it lights and goes out on command. The socket is designed to be closed against moisture and to be easily manufactured by hand or by machine. It includes piercing terminals that, when pressed into the electrical wires that run from light to light in the string, allow electrical connection with the lamp leads and the parallel group device leads.

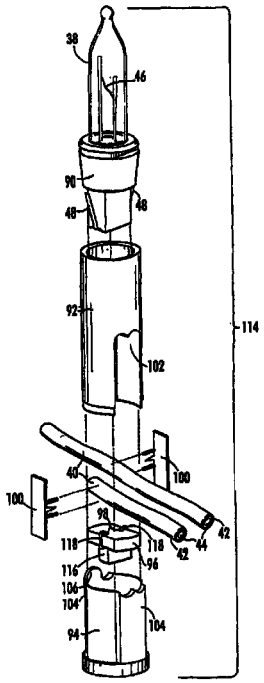

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–7 and 20 is confirmed.

Claims 8 and 21 are determined to be patentable as amended.

Caims 9–19, dependent on an amended claim, are determined to be patentable.

8. A light for use with a string of lights, said lights of said string of lights being in electrical connection with each other by a pair of wires, said light comprising:

a lamp having a filament and a pair of leads in electrical connection to said filament;

a lamp fitting dimensioned to receive said lamp and said pair of leads;

a lamp base;

a sleeve [carried by] *fitted onto* said lamp base and dimensioned to receive said lamp fitting;

terminals carried within said lamp base and extending from said lamp base to said pair of leads of said lamp, said terminals being in electrical connection with said pair of wires when said pair of wires are received by said light; and electronic means in electrical connection with said terminals for passing electrical current through said light when said lamp presents an open circuit to said terminals.

21. A group of lights for use in a string of lights, each light of said group of lights being in a parallel electrical connection with each other light of said group of lights, said group of lights comrprising:

at least two lights having lamps; and means electrically connected in parallel with said group of lights for [passing electrical current through said group of lights to compensate] *compensating* for the change in current caused by any of said lamps presenting an open circuit to said terminals *by beginning to conduct electrical current when a light in said group of lights is missing, burnout out or degraded*.

* * * * *